US012305398B2

(12) United States Patent
Thompson

(10) Patent No.: US 12,305,398 B2
(45) Date of Patent: May 20, 2025

(54) GUTTER AND DOWNSPOUT CLEANING DEVICE AND METHOD

(71) Applicant: GMOLAH, Inc, Lathrop Village, MI (US)

(72) Inventor: Derek Thompson, Lathrup Village, MI (US)

(73) Assignee: GMOLAH, Inc

( * ) Notice: Subject to any disclaimer, the term of this patent is extended or adjusted under 35 U.S.C. 154(b) by 0 days.

(21) Appl. No.: 18/680,231

(22) Filed: May 31, 2024

(65) Prior Publication Data

US 2024/0401337 A1 Dec. 5, 2024

Related U.S. Application Data

(60) Provisional application No. 63/470,312, filed on Jun. 1, 2023.

(51) Int. Cl.
*E04D 13/076* (2006.01)

(52) U.S. Cl.
CPC ..... *E04D 13/0765* (2013.01)

(58) Field of Classification Search
CPC ..... E04D 13/0765
USPC ..... 15/104.001
See application file for complete search history.

(56) References Cited

U.S. PATENT DOCUMENTS 2,910,711 A * 11/1959 Mizelle ..... B05B 1/02 401/48
3,041,655 A * 7/1962 Entler ..... E04D 13/0765 401/289
3,048,139 A * 8/1962 Duckett ..... B63B 21/54 114/221 R
3,799,099 A * 3/1974 Conover ..... B63B 21/54 114/221 R
3,908,910 A 9/1975 Detwiler
3,971,098 A 7/1976 Davis
(Continued)

FOREIGN PATENT DOCUMENTS

CA 2550267 A 12/2006
CN 207633656 U * 7/2018
(Continued)

OTHER PUBLICATIONS

Amazon.com webpage listing for "Gutter Hawg" (available Jun. 4, 2021); https://www.amazon.com/Gutter-Hawg-Cleaning-Tool-Contractor-Grade/dp/B095JBN1SR.
(Continued)

*Primary Examiner* — Marc Carlson
(74) *Attorney, Agent, or Firm* — Van Hoven PC; Stefan D. Osterbur; Joshua Van Hoven

(57) ABSTRACT

Example apparatuses and methods are directed to an apparatus for clearing a downspout connected to a gutter, methods of making the same, and methods of clearing a downspout. An example apparatus may include a base configured to be attached to an extension pole, and a hook secured to the base. The hook comprises a first projection, a second projection, and an intermediate curved portion joining the first and second projections. The second projection extends to an end knob and may be configured to be extended downward through a gutter to position the end knob within a downspout extending below the gutter while the base is positioned below an upper edge of the gutter adjacent the downspout.

13 Claims, 5 Drawing Sheets

(56) References Cited

U.S. PATENT DOCUMENTS

D247,303 S 2/1978 Boyd
D249,010 S 8/1978 Currie
4,121,320 A 10/1978 Feiner
4,150,793 A * 4/1979 Russo ..... E04D 13/0765 239/66
4,168,559 A * 9/1979 Henson ..... E04D 13/0765 15/23
4,182,497 A 1/1980 Ferreira
4,363,335 A 12/1982 Tapper
4,402,106 A 9/1983 Mattson
4,447,927 A * 5/1984 Malless, Jr. ..... E04D 13/0765 401/137
4,502,806 A * 3/1985 Albertson ..... A47L 13/03 401/137
4,673,129 A 6/1987 Kologiy
4,756,043 A * 7/1988 Hazelet ..... B08B 3/02 401/289
4,793,646 A * 12/1988 Michaud, Jr. ..... B63B 21/54 114/221 R
5,003,907 A * 4/1991 Roach ..... B63B 21/54 114/230.25
5,056,187 A * 10/1991 Higgins ..... A47L 9/02 D32/31
5,195,209 A 3/1993 Watkins
5,386,942 A * 2/1995 Dietle ..... B05B 15/656 239/565
5,390,853 A * 2/1995 Ellul ..... B08B 3/024 239/282
5,586,360 A * 12/1996 Diederiks, Jr. ..... A47L 9/327 15/410
D392,781 S * 3/1998 McKnight ..... 401/137
5,725,322 A * 3/1998 Evans ..... B05B 7/2443 401/289
5,727,580 A * 3/1998 Patterson ..... E04D 13/0765 134/201
5,988,715 A * 11/1999 Mason ..... E04D 13/0765 294/181
6,139,077 A 10/2000 Molzan, II
D443,961 S 6/2001 McKnight
6,257,256 B1 * 7/2001 Fischer ..... B08B 3/026 134/167 C
6,397,526 B1 6/2002 Saul et al.
6,925,676 B2 * 8/2005 Heavner ..... E04D 13/0765 294/176
7,549,191 B2 * 6/2009 Seasholtz ..... E04D 13/0765 15/414
D613,012 S 3/2010 Uhlig
D622,016 S 8/2010 Hofmann-Kay et al.
7,913,345 B2 * 3/2011 Dayton ..... B08B 1/32 15/23
7,926,141 B2 * 4/2011 Dayton ..... E04D 13/0765 15/88.4
7,942,106 B2 * 5/2011 Cromartie ..... B63H 19/08 114/221 R
8,024,995 B2 * 9/2011 Dayton ..... B25F 3/00 173/217
D670,881 S 11/2012 Tonge
8,561,623 B2 * 10/2013 Lowenstein ..... B08B 5/04 134/167 R
9,428,914 B2 * 8/2016 Partis, Jr. ..... B05B 13/0627
D816,931 S 5/2018 Ashton-Miller et al.
10,392,809 B2 * 8/2019 Nichols ..... A46B 5/0091
10,465,388 B2 11/2019 Brochu et al.
D897,062 S 9/2020 Berkshire
2001/0042284 A1 11/2001 Gutry
2003/0213086 A1 * 11/2003 Heavner ..... E04D 13/0765 294/24
2004/0064909 A1 * 4/2004 Locklear ..... A46B 9/025 15/160
2004/0143931 A1 * 7/2004 Dennis ..... A47L 5/14 15/405
2008/0022487 A1 * 1/2008 Young ..... A47L 7/0009 15/414
2009/0315354 A1 12/2009 Davia
2011/0100403 A1 * 5/2011 Cox ..... E04D 13/0765 134/167 C
2011/0132405 A1 * 6/2011 Lowenstein ..... E04D 13/0765 134/21
2011/0179598 A1 7/2011 Esteban
2013/0306761 A1 * 11/2013 Chen ..... B05B 1/267 239/589
2015/0368905 A1 * 12/2015 Nichols ..... E04D 13/0765 134/8
2016/0177571 A1 6/2016 Partis, Jr.
2016/0333590 A1 * 11/2016 Fuoco ..... B08B 9/04
2017/0191272 A1 * 7/2017 Ashton-Miller ..... A47L 9/327
2017/0260749 A1 9/2017 Chase
2018/0106045 A1 4/2018 Stauffer
2018/0223536 A1 * 8/2018 Fuoco ..... B08B 9/0436
2023/0101067 A1 * 3/2023 Del Piero ..... B05B 1/14 239/280

FOREIGN PATENT DOCUMENTS

CN 207633657 U * 7/2018
DE 4008062 A1 * 11/1990
DE 19608799 A1 * 9/1997 ..... E04D 13/0765
DE 202004008761 U1 * 9/2004 ..... E04D 13/0765
DE 202004008825 U1 * 11/2005 ..... E04D 13/0765
DE 202012000310 U1 * 8/2012 ..... A46B 5/005
EP 3722531 A1 10/2020
FR 2629418 A3 * 10/1989
GB 2153956 A * 8/1985 ..... E04D 13/0765
GB 2256909 A 12/1992
GB 2302267 A * 7/1997 ..... E04D 13/0765
GB 2404847 A * 2/2005 ..... E04D 13/0765
GB 2601279 A * 5/2022 ..... B08B 3/02
JP H0676515 U * 10/1997
WO 2006057680 A1 6/2006
WO 2018089030 A1 5/2018

OTHER PUBLICATIONS

Gutter Clean Attachment, posted Nov. 8, 2020 [online], [retrieved Nov. 21, 2024]. Retrieved from internet, https://www.amazon.com/BLACK-DECKER-BZOBL50-Connect-Attachment/dp/B075JNM981 (Year: 2020).
Gutter Cleaning Tool, posted Mar. 25, 2021 [online], [retrieved Nov. 21, 2024]. Retrieved from internet, https://www.amazon.com/Tool-Daily-Cleaner-Attachment-Pressure/dp/B0824J49L4 (Year: 2021).
International Search Report and Written Opinion for Application No. PCT/US2024/032005 dated Sep. 17, 2024 (7 pages).

* cited by examiner

GUTTER AND DOWNSPOUT CLEANING DEVICE AND METHOD

CROSS-REFERENCE TO RELATED APPLICATIONS

This application claims the benefit of U.S. Provisional Patent Application No. 63/470,312 filed Jun. 1, 2023, the disclosure of which is hereby incorporated by reference herein in its entirety for all purposes.

INTRODUCTION

The present disclosure is directed to apparatuses and methods for cleaning a gutter, and more particularly for clearing a downspout.

BACKGROUND

Roof gutters direct water off of a roof of a building. Typically, gutters collect water along an edge of a roof, funneling the collected water to a downspout. Downspouts typically direct the water from the gutter into a drain or into the ground. Water flowing along the roof may collect leaves, branches, or debris. The debris tends to flow into the gutter and to the downspout. Accordingly, downspouts may become clogged by accumulation of debris absent regular maintenance.

Known apparatuses for cleaning gutters require accessing the gutter along an elevated roof edge, which in turn requires climbing a ladder and/or climbing onto the roof. Accordingly, appropriate cleaning and maintenance of a gutter and/or downspout is often difficult and potentially dangerous.

SUMMARY

In at least some examples, a downspout clearing apparatus comprises a base configured to be attached to an extension pole, and a hook secured to the base. The hook comprises a first projection having a first longitudinal axis configured to be oriented parallel to an extension pole axis when the base is secured to the extension pole. The first projection extends away from the base a first distance along the first longitudinal axis. The hook includes a second projection having a second longitudinal axis and extending a second distance along the second longitudinal axis to an end knob. The hook may further include an intermediate curved portion joining the first projection to the second projection such that the first longitudinal axis defines an acute angle with respect to the second longitudinal axis. Additionally, the second distance extends such that the second projection extends downward through a gutter and positions the end knob within a downspout extending below the gutter while the base is positioned below an upper edge of the gutter adjacent the downspout.

In at least some example apparatuses, the base and the hook may be integrally formed in a monolithic single piece, and the base defines a female bore having a thread configured to be attached to an extension pole. Additionally, the first projection may be tapered such that the first projection is narrower at a first location adjacent to the intermediate curved portion than at a second location adjacent to the base. Further, the end knob of the second projection may include a hemispherical end surface defining a circumferentially extending edge, with the circumferentially extending edge defining an edge radius larger than a second projection radius adjacent the end knob. The acute angle may, in at least some examples, be between 5 degrees and 25 degrees. Additionally, in these examples the hook may be formed of a resilient material configured to allow the second projection to deflect relative to the first projection in response to a lateral force applied by the gutter or the downspout to the second projection.

In at least some examples, a method of making a downspout clearing apparatus comprises providing a base configured to be secured to an extension pole and forming a hook secured to the base. The hook comprises a first projection having a first longitudinal axis configured to be oriented parallel to an extension pole axis when the base is secured to the extension pole, with the first projection extending away from the base a first distance along the first longitudinal axis. The hook also comprises a second projection having a second longitudinal axis and extending a second distance along the second longitudinal axis to an end knob. The hook also includes an intermediate curved portion joining the first projection to the second projection. The first longitudinal axis may define an acute angle with respect to the second longitudinal axis and the second distance extends such that the second projection extends downward through a gutter and positions the end knob within a downspout extending below the gutter while the base is positioned below an upper edge of the gutter adjacent the downspout.

BRIEF DESCRIPTIONS OF THE DRAWINGS

The above and other objects and advantages of the disclosure may be apparent upon consideration of the following detailed description, taken in conjunction with the accompanying drawings, in which.

DETAILED DESCRIPTION

Example apparatuses described herein generally include a base and a hook that facilitates accessing a downspout by a user positioned below the gutter, e.g., while standing on the ground. Accordingly, a downspout may be cleared without requiring a user to climb a ladder or onto an adjacent roof to do so. By contrast, known apparatuses and methods are focused on cleaning gutters and cannot penetrate into a downspout to clear debris in the same manner. Furthermore, example apparatuses and methods herein may be used to access and clear any downspout, and as such are generally universal for all widths and configurations of a gutter.

Generally, a hook of an example apparatus may be secured to a base that allows for selectively attaching or securing the base to an extension pole or other elongate device that facilitates reaching an elevated gutter. The hook may thereby be raised in a generally vertical orientation by a user extending the pole vertically toward an elevated gutter and downspout. The hook may be configured such that the end of the hook can be inserted downwardly through the elevated gutter and into the downspout extending below the gutter. The portion of the hook adjacent to the end thereof may be relatively thin to facilitate penetrating debris, while a knob or other enlargement at the end of the hook may help clear the downspout by "grabbing" branches, leaves, or other debris. Additionally, the enlarged end or knob may enhance safety by reducing the sharpness of the relatively thin hook end.

Figure 1:
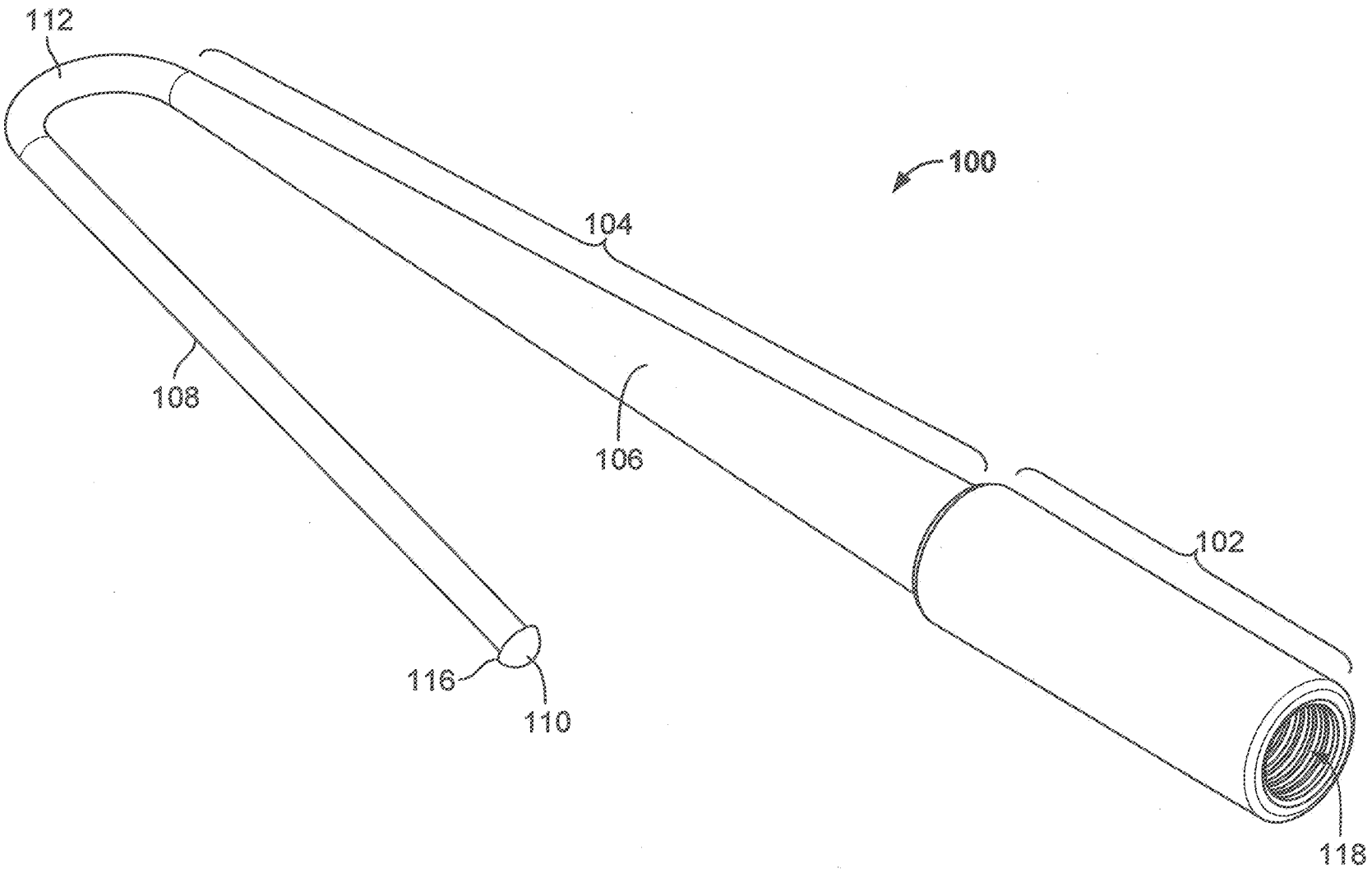
FIG. 1 depicts a perspective view of an apparatus for clearing a downspout, in accordance with some embodiments of the disclosure.
Figure 2:
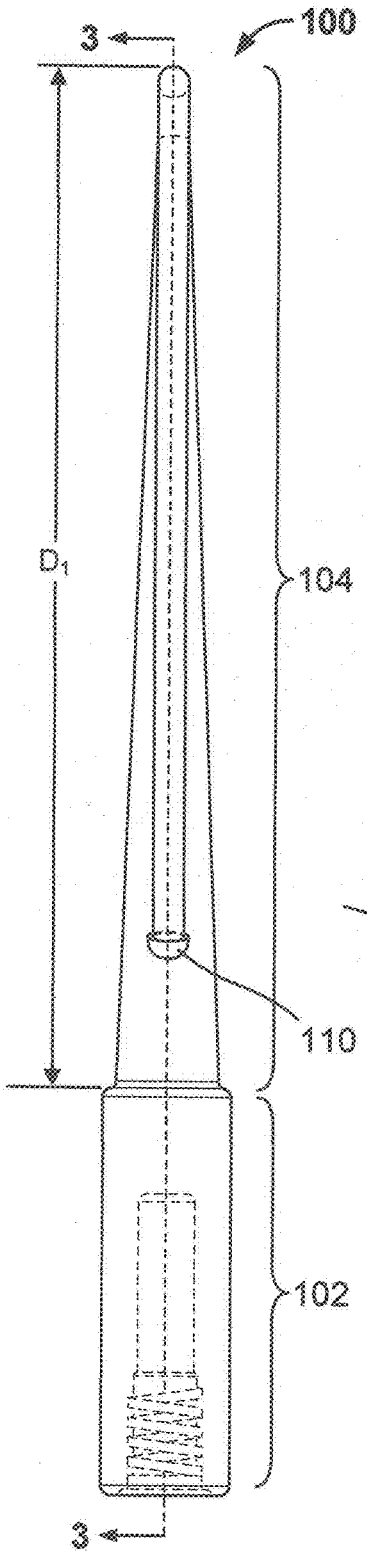
FIG. 2 depicts a side view of the downspout clearing apparatus of FIGS. 1A and 1B, in accordance with some embodiments of the disclosure.
Figure 3:
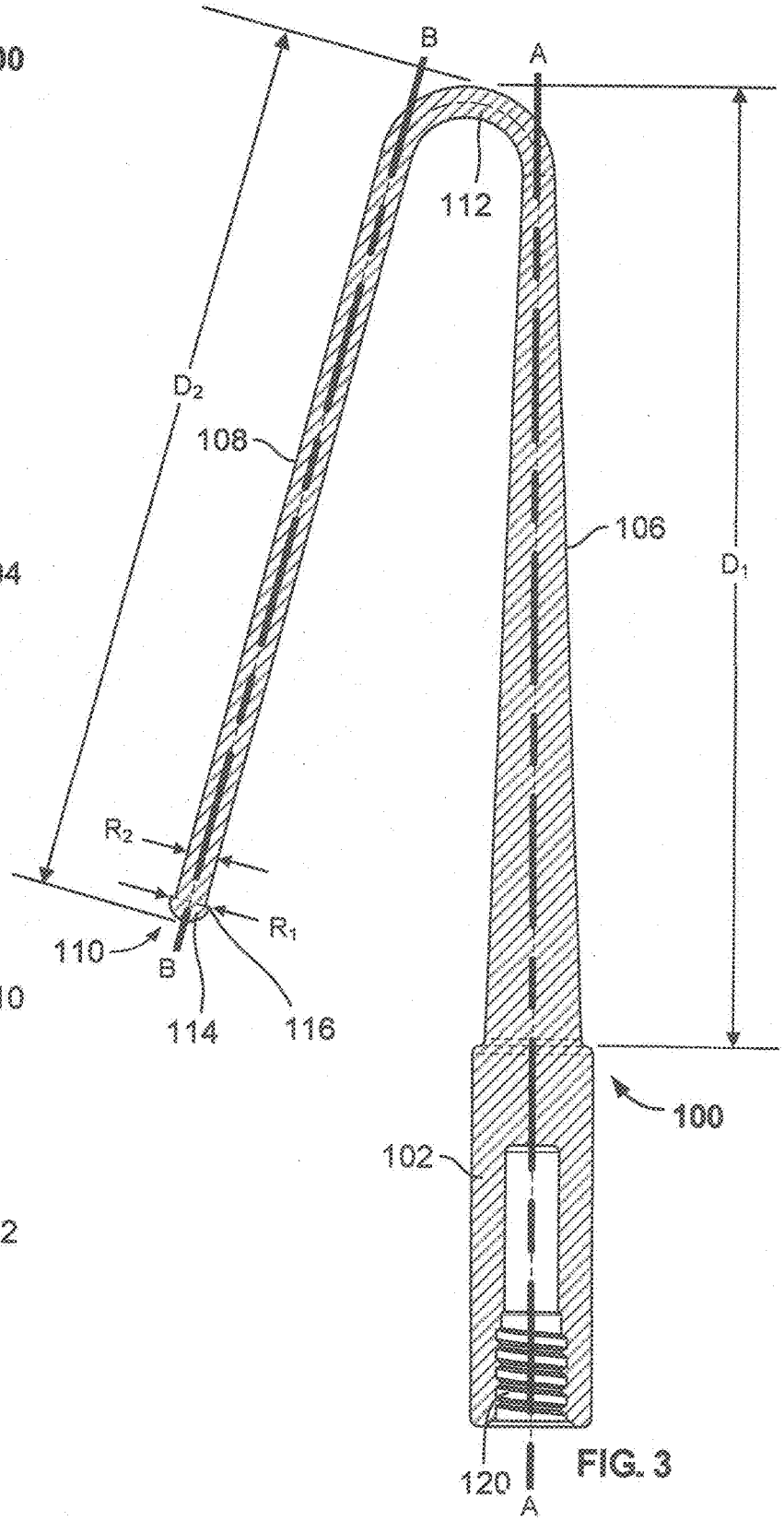
FIG. 3 depicts a cross-sectional view of the downspout clearing apparatus of FIG. 2 along line 3-3, in accordance with some embodiments of the disclosure.

Turning now to FIGS. 1-3, a downspout clearing apparatus 100 is illustrated and described in further detail. The apparatus 100 may include a base 102 configured to be attached to an extension pole (not shown in FIGS. 1-3). For example, the base 102 may define a female bore 118 having thread(s) 120 that facilitate securement to, e.g., a corresponding threaded male member of an extension pole. Merely by way of example, an extension pole may have a standardized broom handle-type thread, and the threading of the female bore of the base may correspond to the standardized thread to facilitate attachment to a variety of different length or configuration extension poles.

A hook 104 may be secured to the base 102. The hook 104 may comprise a first projection 106, a second projection 108, and an intermediate curved portion 112, which extends from the first projection 106 to the second projection 108.

As noted above, the hook 104 may generally be shaped or configured to facilitate clearing a downspout. In the example illustrated in FIGS. 1-3, the intermediate curved portion 112 is curved such that a longitudinal axis A-A of the first projection 106 is positioned at an acute angle $\alpha$ with respect to a longitudinal axis B-B of the second projection 108. The angle $\alpha$ is 15 degrees in the example illustrated in FIGS. 1-3, however the angle $\alpha$ may be any other angle that facilitates lowering of the end knob 110 and at least a portion of the second projection 108 into a downspout while the first projection 106 is held in a generally vertical orientation, e.g., by a user standing below a gutter and/or downspout. In the example illustrated in FIGS. 1-3, the angle $\alpha$ is between 5 and 25 degrees. In other examples, the angle $\alpha$ can be larger than 25 degrees, however a larger angle will generally require the user to stand further horizontally from the downspout and gutter, and may as a result increase difficulty of unclogging a downspout. Additionally, a smaller angle than illustrated may reduce flexibility of unclogging downspouts in larger gutters, e.g., 4" to 6" gutters. In at least some examples, the angle $\alpha$ may be larger than 15 degrees to the extent the second projection 108 may still be lowered in a substantially vertical orientation by a user positioned on a ground surface below a downspout opening within a gutter. Further, in at least some examples, the angle $\alpha$ may be smaller than 15 degrees to the extent the second projection 108 is spaced apart from the first projection 106 so as to not interfere with lowering the second projection 108 into a downspout opening. In this manner, the apparatus 100 may be used to clear a downspout while a user is positioned at a ground surface below the gutter and downspout, as will be further illustrated and described below.

As noted above, the first projection 106 may be characterized by a first longitudinal axis A-A. The first projection 106 generally extends a distance $D_1$ from the base 102 to an end of the hook 104. Additionally, the second projection 108 may be generally cylindrical, and may be characterized by a second longitudinal axis B-B and extends a second distance $D_2$ along the second longitudinal axis B-B from the end of the hook 104 to an end knob 110. The end knob 110 is positioned at a free end of the second projection 108, and as will be described further below is configured to be used to scrape an interior surface of a downspout connected to a gutter.

Generally, when the base 102 is secured to an extension pole the first projection 106 may be oriented parallel to the extension pole, e.g., parallel to an axis of the extension pole. The angle $\alpha$ between the first projection 106 and the second projection 108 is generally established by a curvature of the intermediate curved portion 112. The angle $\alpha$ may be acute as noted above, e.g., between 5 and 25 degrees, and the second projection 108 may be nearly as long as the first projection 106 such that the second projection 108 may be "hung" over the lip of an elevated gutter to allow the end knob 110 to be projected down into a downspout. Accordingly, as will be described further below the second projection 108 may extends downward through a gutter such that the end knob 110 is positioned within a downspout extending below the gutter while the base 102 is positioned below an upper edge of the gutter adjacent the downspout.

The end knob 110 may be relatively wider than the second projection 108. The end knob 110 have a hemispherical end surface 114 that is generally rounded due to the hemispherical shape. Accordingly, the end knob 110 is not relatively "dull" to reduce a possibility of injury. The end knob 110 also may define a circumferentially extending edge 116. As will be described further below, the circumferentially extending edge 116 may be configured to be applied to an interior surface of a downspout. Accordingly, the end knob 110 may be used to generally scrape or grab debris to facilitate unclogging the downspout. The circumferentially extending edge 116 may generally encircle the second projection 108, such that the circumferentially extending edge 116 extends around an entire circumference of the second projection 108. Additionally, the circumferentially extending edge 116 may define an edge radius $R_1$ that is relatively larger than a second projection radius $R_2$ adjacent to the end knob 110. In this manner, the end knob 110 may define a relatively enlarged or flared shape relative to the second projection 108.

As best seen in FIG. 3, the first projection 106 may generally taper away from the base 102. Accordingly, the first projection 106 may be relatively narrower further away from the base 102. Put another way, the first projection 106 may be relatively narrower at a location adjacent the intermediate curved portion 112 than at a second location adjacent the base 102.

The apparatus 100 may be formed in any manner that is convenient. In the illustrated example shown in FIGS. 1-3, the base 102 and hook 104 are formed integrally as a single monolithic piece. For example, the base 102 and hook 104 may be molded, e.g., in an injection molding process. Additionally, the hook 104 may be formed of a resilient material that generally allows deflection of the hook 104 while being used to clear a downspout. For example, second projection to deflect relative to the first projection in response to a lateral force applied by the gutter or the downspout to the second projection. Merely by way of example, the hook 104 may be formed of a nylon or other plastic material. In other examples, the hook 104 may be formed of a steel material, or a combination of steel and plastic. It should be noted that to the extent steel material is used for the hook 104 or otherwise in the apparatus 100, strength, weight, and cost may be comparatively increased to the extent the steel material used in place of a plastic material.

Figure 4A:
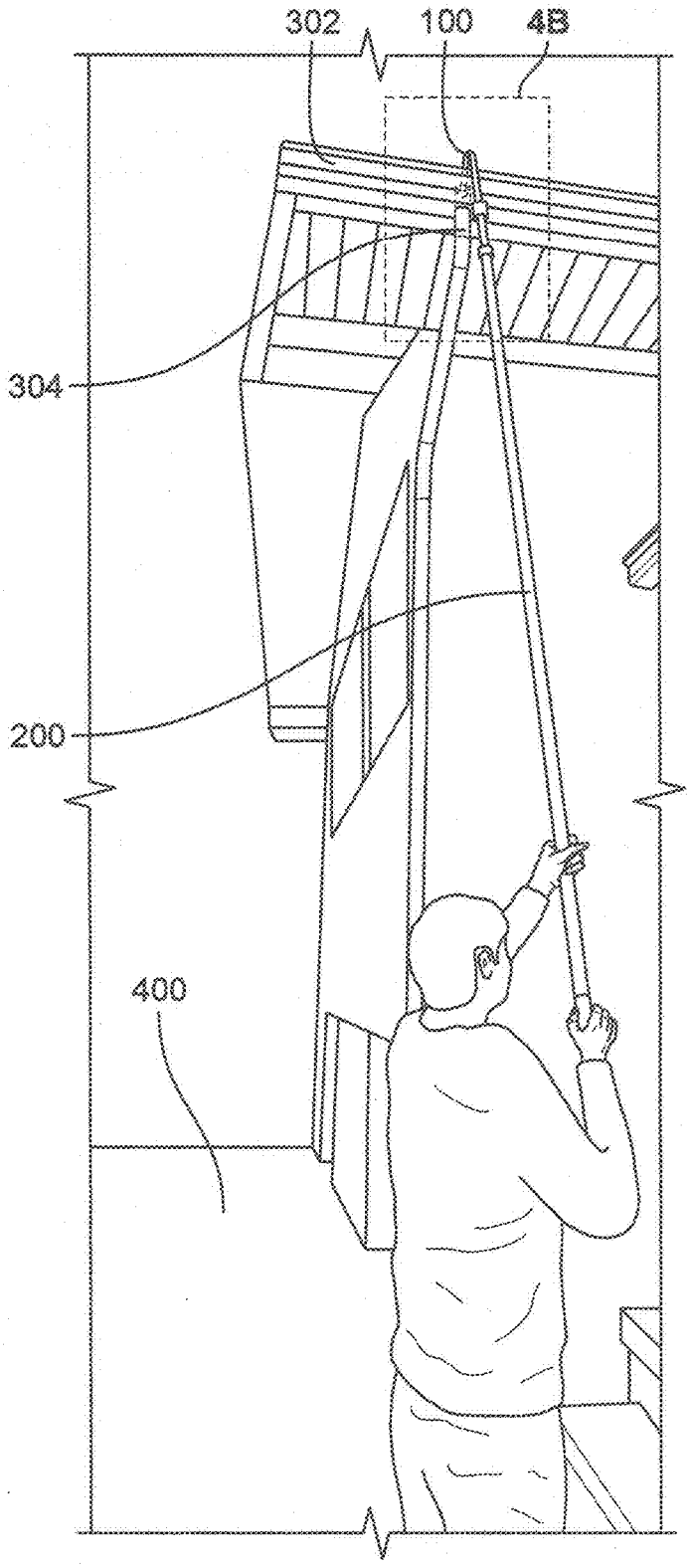
FIG. 4A depicts a perspective view of a user clearing a downspout using the downspout clearing apparatus of FIGS. 1A, 1B, 2, and 3, in accordance with some embodiments of the disclosure.
Figure 4B:
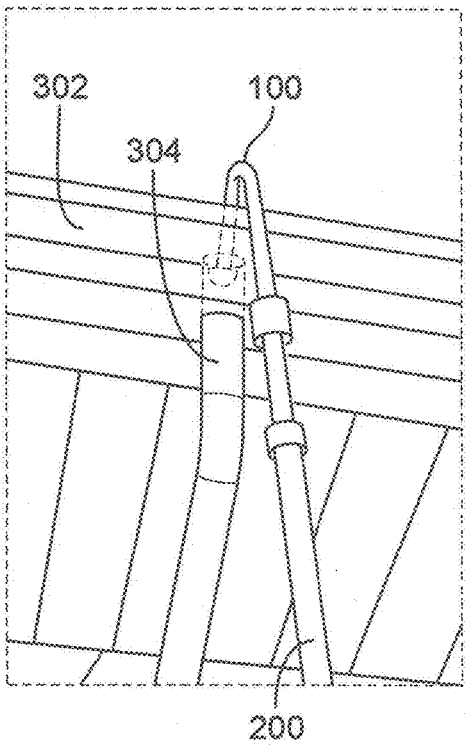
FIG. 4B depicts an enlarged portion of detail 4A in FIG. 4A to show the downspout clearing apparatus, in accordance with some embodiments of the disclosure.
Figure 4C:
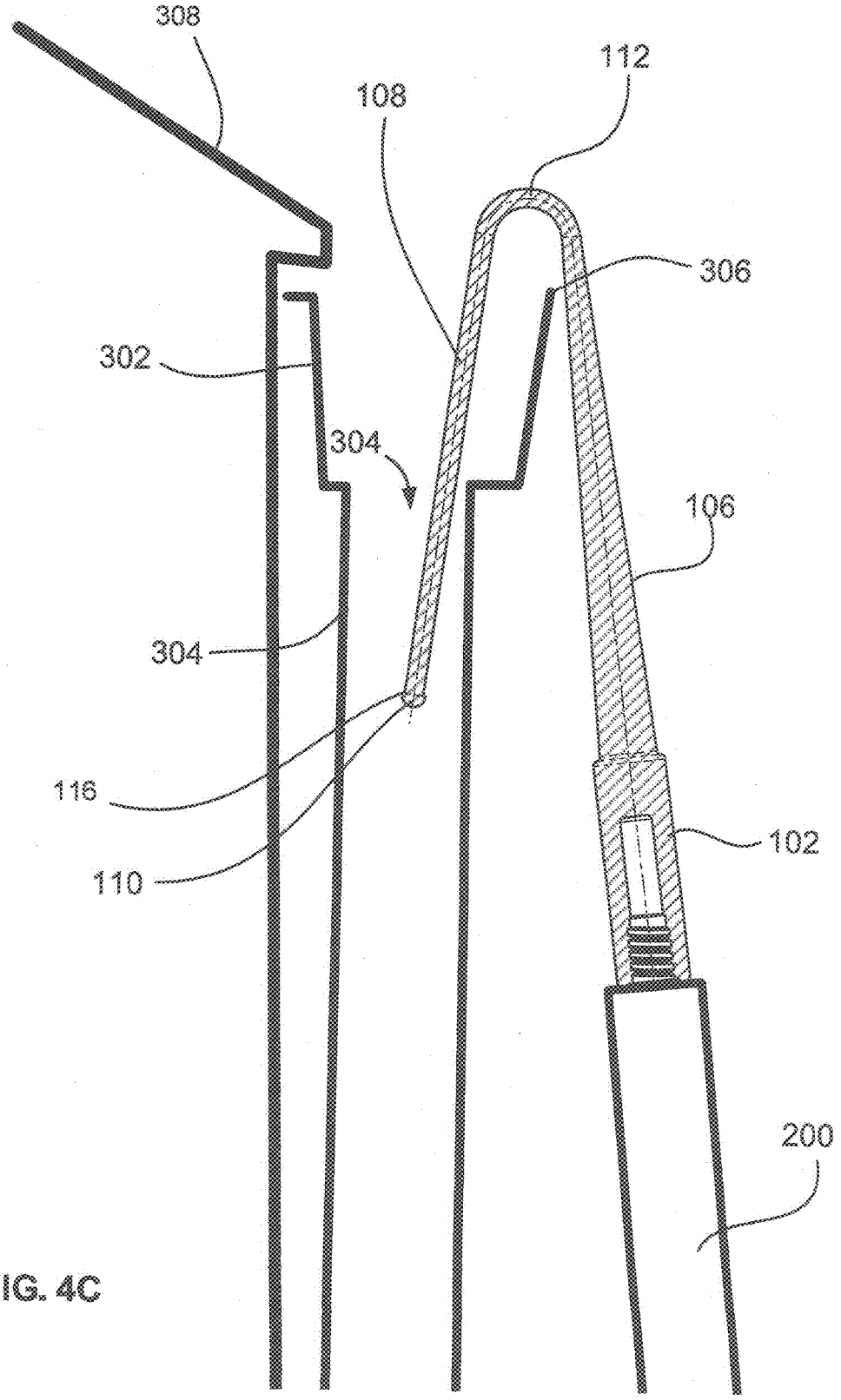
FIG. 4C is a cross-sectional view of the downspout clearing apparatus illustrated in FIGS. 3 and 4A/4B.

Referring now to FIGS. 4A-4C, the apparatus 100 is illustrated in use for clearing a downspout of an elevated gutter. The apparatus 100 may be secured to an extension pole 200 by a user, e.g., by mating the threads 120 of the base 102 to a corresponding male thread (not shown) of the extension pole 200. The user may then raise the apparatus 100 toward the gutter 302 and downspout 304 via the extension pole 200. Upon raising the end knob 110 above the gutter 302, e.g., above an upper edge 306 of the gutter 302, the user may guide the end knob 110 downward through the gutter 302 and into the downspout 304, e.g., using the exterior of the downspout 304 as a visual guide for placement of the end knob 110 along the gutter 302 to ensure insertion into the downspout 304. Accordingly, as best seen in FIGS. 4B and 4C, the end knob 110 may be placed down in the downspout 304, contacting any leaves, branches, shingle grit, or other debris that may be present in the downspout 304 and adjacent areas of the gutter 302. The rounded or hemispherical surface of the end knob 110 may facilitate penetrating debris, while the circumferentially extending edge 116 may facilitate scraping of interior surfaces of the downspout 304. Further, the circumferentially extending edge 116 may be used to grab or lift debris. Accordingly, a repetitive up/down movement of the second projection 108 within the downspout 304 may loosen debris, allowing it to flow downward through the downspout 304 to a drain, into the ground, etc. Alternatively, the circumferentially extending edge may also facilitate lifting larger debris, e.g., branches or twigs, up and out of the downspout 304 and/or the gutter 302. The apparatus 100 may be particularly effective at removing or clearing the downspout 304 while water is flowing through the gutter 302 to the downspout 304, e.g., while rain is falling on the adjacent roof surface 308. Alternatively, a garden hose or the like may be employed to supply water flowing within the gutter 302 and to the downspout 304.

Furthermore, as noted above the user may accomplish the operations of clearing the downspout 304 without being required to access a roof, e.g., roof surface 308, above the ground surface 400, or to even climb a ladder to gain access to the elevated gutter. Moreover, the user may remain standing on the ground surface 400, given a sufficient length of the extension pole 200 to raise the apparatus 100 to the gutter 302 and/or downspout 304.

Figure 5:
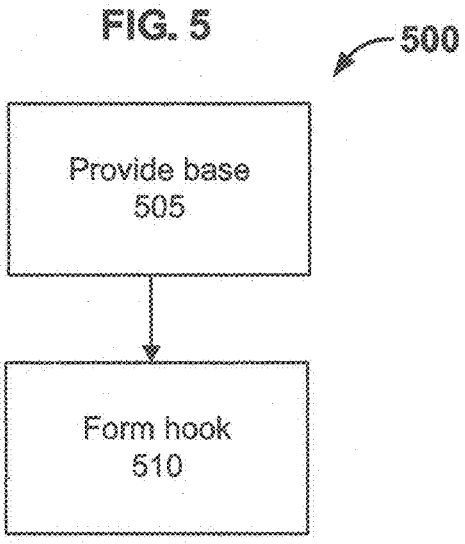
FIG. 5 is a flow chart representing an illustrative method of making a downspout clearing apparatus, in accordance with some embodiments of the disclosure.

Turning now to FIG. 5, a process 500 of making a downspout clearing apparatus is illustrated and described in further detail. Process 500 may begin at block 505, where a base is provided, e.g., base 102. For example, as noted above the base 102 may be configured to be attached to an extension pole 200, allowing the apparatus 100 to reach elevated gutters and downspouts relatively easily. The base 102 may have a specific attachment mechanism, such as a threaded connection, clamping system, etc., to ensure a stable and secure fit on the extension pole 200. Process 500 may then proceed to block 510.

At block 510, the hook may be formed, e.g., hook 104. The hook 104, as noted above, may generally extend from the base 102 and may be used to clear debris from the downspout 304. The hook 104, as noted above may include first projection 106, second projection 108, and an intermediate curved portion 112. The first projection 106, as noted above, may have a longitudinal axis A-A configured to be aligned substantially or nearly parallel the extension pole or axis thereof when the base 102 is attached to the extension pole 200. Further, as described above the first projection 106 may extend a desired distance $D_1$, with the second projection 108 extending a desired distance $D_2$ and an angle $\alpha$ between the first projection 106 and second projection 108 to facilitate positioning of the end knob 110 within a downspout 304. In at least some examples, the distance $D_1$ may be relatively larger than the distance $D_2$, corresponding to the first projection 106 being relatively longer than the second projection 108. Further, the second projection 108 may be nearly as large as the first projection 106 in length, while also being relatively thinner than the first projection 106. Accordingly, the second projection 108 may be configured to better penetrate into debris, deflect in response to bumping against interior surfaces of the downspout, etc. By contrast, the first projection 106 may be relatively stiffer, providing overall strength and durability of the hook 104.

In an example, the distance $D_1$ is 10.0 inches, while the distance $D_2$ is 9.0 inches. In this example, the first projection 106 tapers from an initial width or diameter of 1.0 inches where the first projection 106 meets the base 102 to a width or diameter of 0.313 inches where the first projection 106 meets the intermediate curved portion 112. Additionally, in this example the second projection 108 has a cylindrical outer surface having a diameter of 0.313 inches (i.e., identical to the intermediate curved portion 112), while the circumferentially extending edge 116 of the end knob 110 has a radius of 0.2 inches. Further, the radius of the circumferentially extending edge 116 corresponds to a radius of the hemispherical end surface of the end knob 110. It should be understood that in other example approaches one or more of these dimensions may be different than described in this example.

As noted above, in some example approaches the hook 104 may be formed integrally as a monolithic single piece with the base 102. For example, an injection molding process may be used to form the base 102 and hook 104, e.g., of a nylon or other plastic material. Any other material that may be convenient may be employed. The material used to form the hook 104 may, at least in some examples, generally allow for deflection of the relatively thin second projection 108 during use, e.g., to allow the end knob 110 to scrape along interior surface(s) of the downspout 304 in use, or to prevent damage to the gutter 302 and/or downspout 304. An integral construction of the base 102 and hook 104 may facilitate a relatively smooth outer surface of the apparatus 100, e.g., such that the apparatus 100 is without any joints or seams that might reduce durability or strength. Additionally, the hook 104 and the base 102 being made from a resilient material may facilitate deflection of the second projection 108 relative to the first projection 106 when a lateral force is applied, e.g., as a result of contact with interior surface(s) of a downspout 304, a user applying force side to side on the apparatus 100 while positioned within the downspout 304 in an effort to loosen or remove debris, etc. The deflection capability may also facilitate navigating internal contours of the gutter 302 and downspout 304 by the user from the ground surface without visibility into the gutter 302 and opening of the downspout 304, preventing breakage or damage to the apparatus 100 during use. Process 500 may then terminate.

Figure 6:
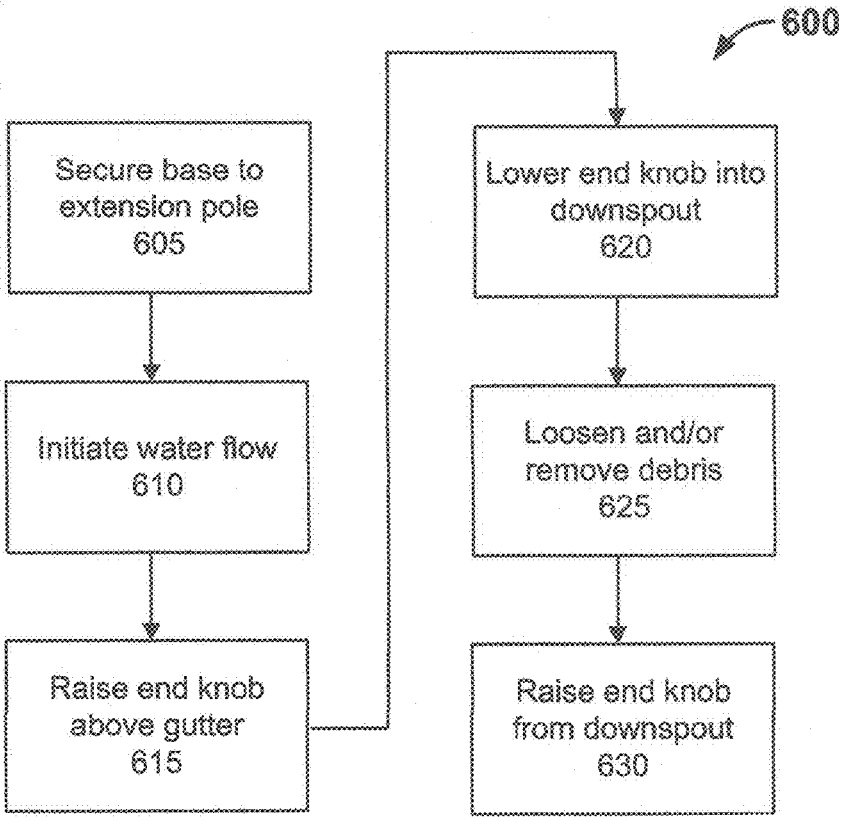
FIG. 6 is a flow chart representing an illustrative method of clearing a downspout, in accordance with some embodiments of the disclosure.

Turning now to FIG. 6, a process 600 of clearing an elevated gutter and/or downspout from a ground surface is illustrated and described in further detail. Process 600 may begin at block 605, where a user may secure a base of a downspout clearing apparatus to an extension pole or any other elongate member that allows the user to place the apparatus adjacent the gutter.

Proceeding to block 610, the user may initiate flow of water toward the downspout 304 in which debris or a clog is present. For example, as noted above the user may perform the downspout clearing operation while rainwater is flowing through a gutter 302 toward a downspout 304. Process 600 may then proceed to block 615.

At block 615, the user may raise the end knob of the downspout clearing apparatus above the gutter, e.g., gutter 302. At block 620, the user may lower the end knob 110 into the downspout 304. For example, having raised the end knob 110 above an uppermost edge or lip of a gutter 302, the user may lower the end knob 110 through the gutter 302 and into the downspout 304.

Proceeding to block 625, the user may loosen and/or remove debris positioned within the downspout. For example, with the end knob 110 positioned within the downspout 304, the user may repetitively raise and lower the end knob, e.g., to penetrate, loosen, and/or remove leaves, branches, or other debris within the downspout 304. As noted above, in at least some example approaches the end knob 110 is positioned at the end of the second projection 108 and includes a hemispherical end surface 114. Accordingly, the end knob 110 may present a rounded, smooth contact point that can engage with the interior surfaces of the downspout 304 without causing damage, and to avoid injury to a user or others during installation/removal of the apparatus 100 from the extension pole. Additionally, as noted above, the hemispherical end surface 114 may have a circumferentially extending edge 116 configured to contact interior surface(s) of the gutter 302 and/or downspout 304. This circumferentially extending edge 116 may promote effective clearing of debris as the apparatus 100 and end knob 110 is moved within the downspout 304. Additionally, as noted above in some examples the circumferentially extending edge 116 may have a larger radius than that of the second projection 108 adjacent to the end knob 110. The relatively flared end knob 110 and circumferentially extending edge 116 being relatively larger than the second projection 108 may allow the circumferentially extending edge 116 to scrape along interior surfaces of the downspout 304. Additionally, the enlarged radius/size of the circumferentially extending edge 116 may also allow the end knob 110 to "grab" or otherwise move debris upwardly via upward motion of the apparatus 100. Process 600 may then proceed to block 630.

At block 630, the end knob 110 may be withdrawn from the downspout. For example, the user may raise extension pole 200 such that the end knob 110 is moved out of the downspout 304 and above the gutter 302, allowing the user to lower the apparatus 100. The apparatus 100 may subsequently be removed from the extension pole 200 and stored, if desired. Process 600 may then terminate.

The example apparatuses and methods described herein may facilitate clearing downspouts of a residential or commercial building having a gutter that is elevated but accessible by an extension pole. Accordingly, a user may relatively safely access a clogged downspout and loosen or remove debris while standing on a ground surface below the gutter and/or downspout, thereby avoiding the need to climb a ladder or climb onto a roof surface adjacent the gutter/downspout.

The following numbered paragraphs set forth example methods of making and/or using a downspout clearing apparatus, e.g., an apparatus 100 consistent with the above-described and illustrated examples.

Numbered paragraph 1. A method of making a downspout clearing apparatus, comprising:

providing a base configured to be secured to an extension pole;

forming a hook secured to the base, the hook comprising:

a first projection having a first longitudinal axis configured to be oriented parallel to an extension pole axis when the base is secured to the extension pole, the first projection extending away from the base a first distance along the first longitudinal axis;

a second projection having a second longitudinal axis and extending a second distance along the second longitudinal axis to an end knob; and an intermediate curved portion joining the first projection to the second projection, wherein the first longitudinal axis defines an acute angle with respect to the second longitudinal axis and the second distance extends such that the second projection extends downward through a gutter and positions the end knob within a downspout extending below the gutter while the base is positioned below an upper edge of the gutter adjacent the downspout.

Numbered paragraph 2. The method of numbered paragraph 1, wherein the end knob includes a hemispherical end surface defining a circumferentially extending edge.

Numbered paragraph 3. The method of numbered paragraph 2, wherein the circumferentially extending edge is configured to be applied to an interior surface of the downspout.

Numbered paragraph 4. The method of numbered paragraph 2, wherein the circumferentially extending edge defines an edge radius larger than a second projection radius adjacent the end knob.

Numbered paragraph 5. The method of numbered paragraph 1, wherein the first projection is tapered such that the first projection is narrower at a first location adjacent the intermediate curved portion than at a second location adjacent the base.

Numbered paragraph 6. The method of numbered paragraph 1, wherein the acute angle is between 5 degrees and 25 degrees.

Numbered paragraph 7. The method of numbered paragraph 1, wherein forming the hook secured to the base comprises forming the hook and the base integrally in a monolithic single piece.

Numbered paragraph 8. The method of numbered paragraph 7, wherein the hook and the base are formed of a resilient material configured to allow the second projection to deflect relative to the first projection in response to a lateral force applied by the gutter or the downspout to the second projection.

Numbered paragraph 9. A method of increasing flow through a downspout, comprising:

securing a base of a downspout clearing apparatus to an end of an extension pole;

while handling the extension pole at a position below a gutter associated with the downspout:

raising the extension pole to bring an end knob of the downspout clearing apparatus above the gutter;

lowering the end knob into the downspout; and loosening debris positioned within the downspout with the end knob.

Numbered paragraph 10. The method of numbered paragraph 9, further comprising withdrawing the end knob from the downspout.

Numbered paragraph 11. The method of numbered paragraph 9, wherein handling the extension pole at a position below the gutter associated with the downspout comprises the user standing on a surface below the gutter.

Numbered paragraph 12. The method of numbered paragraph 11, wherein the surface below the gutter is a ground surface.

Numbered paragraph 13. The method of numbered paragraph 9, further comprising initiating a flow of water toward the downspout.

Numbered paragraph 14. The method of numbered paragraph 9, wherein a hook is secured to the base, the hook comprising:

a first projection having a first longitudinal axis configured to be oriented parallel to an extension pole axis when the base is secured to the extension pole, the first projection extending away from the base a first distance along the first longitudinal axis;

a second projection having a second longitudinal axis and extending a second distance along the second longitudinal axis to the end knob; and an intermediate curved portion joining the first projection to the second projection, wherein the first longitudinal axis defines an acute angle with respect to the second longitudinal axis and the second distance extends such that the second projection extends downward through a gutter and positions the end knob within a downspout extending below the gutter while the base is positioned below an upper edge of the gutter adjacent the downspout.

Numbered paragraph 15. The method of numbered paragraph 14, wherein the base comprises a female bore having a thread;

wherein the first projection is tapered such that the first projection is narrower at a first location adjacent the intermediate curved portion than at a second location adjacent the base;

wherein the end knob includes a hemispherical end surface defining a circumferentially extending edge, and the circumferentially extending edge defines an edge radius larger than a second projection radius adjacent the end knob;

wherein the acute angle is between 5 degrees and 25 degrees;

wherein the hook and the base are integrally formed in a monolithic single piece; and wherein the hook is formed of a resilient material configured to allow the second projection to deflect relative to the first projection in response to a lateral force applied by the gutter or the downspout to the second projection.

The foregoing is merely illustrative of the principles of this disclosure and various modifications may be made by those skilled in the art without departing from the scope of this disclosure. The embodiments described herein are provided for purposes of illustration and not of limitation. Thus, this disclosure is not limited to the explicitly disclosed systems, devices, apparatuses, components, and methods, and instead includes variations to and modifications thereof, which are within the spirit of the attached claims.

The systems, devices, apparatuses, components, and methods described herein may be modified or varied to optimize the systems, devices, apparatuses, components, and methods. Moreover, it will be understood that the systems, devices, apparatuses, components, and methods may have many applications. The disclosed subject matter should not be limited to any single embodiment described herein, but rather should be construed according to the claims.

What is claimed is:

1. A downspout clearing apparatus, comprising:

a base configured to be attached to an extension pole;

a hook secured to the base, the hook formed of a resilient material and comprising:

a first projection having a first longitudinal axis configured to be oriented parallel to an extension pole axis when the base is secured to the extension pole, the first projection extending away from the base a first distance along the first longitudinal axis;

a second projection having a second longitudinal axis and extending a second distance along the second longitudinal axis to an end knob; and an intermediate curved portion joining the first projection to the second projection, wherein the first longitudinal axis defines an acute angle with respect to the second longitudinal axis and the second distance extends such that the second projection extends downward through a gutter and positions the end knob within a downspout extending below the gutter while the base is positioned below an upper edge of the gutter adjacent the downspout;

wherein the end knob includes:

a hemispherical end surface defining a circumferentially extending edge at a radially outer portion of the hemispherical end surface, the circumferentially extending edge defining an edge radius larger than a second projection radius adjacent the end knob; and an annular surface extending radially inwardly from the circumferentially extending edge, the annular surface facing away from hemispherical end surface along the second longitudinal axis, such that the circumferentially extending edge is configured to scrape an interior surface within the downspout; and wherein the first projection is relatively stiffer than the second projection to allow the second projection to deflect relative to the first projection in response to a lateral force applied by the gutter or the downspout to the second projection.

2. The downspout clearing apparatus of claim 1, wherein the circumferentially extending edge extends around an entire circumference of the second projection.

3. The downspout clearing apparatus of claim 1, wherein the first projection is tapered such that the first projection is narrower at a first location adjacent the intermediate curved portion than at a second location adjacent the base.

4. The downspout clearing apparatus of claim 1, wherein the second projection is cylindrical.

5. The downspout clearing apparatus of claim 1, wherein the acute angle is between 5 degrees and 25 degrees.

6. The downspout clearing apparatus of claim 1, wherein the hook and the base are integrally formed in a monolithic single piece.

7. The downspout clearing apparatus of claim 1, wherein the base comprises a female bore having a thread.

8. The downspout clearing apparatus of claim 1, wherein the base comprises a female bore having a thread;

wherein the first projection is tapered such that the first projection is narrower at first location adjacent the intermediate curved portion than at a second location adjacent the base;

wherein the acute angle is between 5 degrees and 25 degrees; and wherein the hook and the base are integrally formed in a monolithic single piece.

9. The downspout clearing apparatus of claim 1, wherein the annular surface extends radially inwardly to the second projection from the circumferentially extending edge.

10. The downspout clearing apparatus of claim 1, wherein the annular surface is planar.

11. The downspout clearing apparatus of claim 1, wherein the annular surface is orthogonal to the second longitudinal axis of the second projection.

12. The downspout clearing apparatus of claim 1, wherein the resilient material includes a plastic material.

13. The downspout clearing apparatus of claim 1, wherein the second projection defines a cylindrical shape having the second projection radius, and wherein the edge radius is greater than the second projection radius.

* * * * *